United States Patent [19]
Olson et al.
[11] 4,318,278
[45] Mar. 9, 1982

[54] ICE MAKING MACHINE

[75] Inventors: John T. Olson, Albert Lea; Robert K. Westergaard, Alden, both of Minn.

[73] Assignee: King-Seeley Thermos Co., Prospect Heights, Ill.

[21] Appl. No.: 122,737

[22] Filed: Feb. 19, 1980

Related U.S. Application Data

[63] Continuation of Ser. No. 921,835, Jul. 3, 1978, abandoned.

[51] Int. Cl.[3] ..... F25C 5/18
[52] U.S. Cl. ..... 62/347; 62/196 A; 62/510
[58] Field of Search ..... 62/510, 196 A, 117, 62/74, 347

[56] References Cited

U.S. PATENT DOCUMENTS

| | | | |
|---|---|---|---|
| 2,855,763 | 10/1958 | Dean et al. | 62/448 X |
| 2,999,369 | 9/1961 | Swanson et al. | 62/320 |
| 3,126,713 | 3/1964 | Parker | 62/196 A X |
| 3,908,390 | 9/1975 | Dickson et al. | 62/73 |
| 4,184,341 | 1/1980 | Friedman | 62/510 X |
| 4,193,270 | 3/1980 | Scott | 62/196 A X |

*Primary Examiner*—William E. Tapolcai, Jr.
*Attorney, Agent, or Firm*—Harness, Dickey & Pierce

[57] ABSTRACT

A high capacity ice making machine comprising a plurality of ice producing mechanisms, each of which is provided with a plurality of ice forming molds or cups having a rotatable water spray bar located therebelow for communicating make-up water from a water sump toward the molds during a freezing cycle. The ice producing mechanisms are arranged in two tandem pairs and communicate ice produced during the freezing cycle into a common ice storage bin located therebelow. The refrigeration systems associated with each of the ice producing mechanisms employ a common refrigerant condenser which is mounted by means of a hinge arrangement whereby to permit movement of the condenser between a normally closed position and an open position to provide access to the interior of the ice making machine for purposes of inspection, maintenance and the like.

3 Claims, 5 Drawing Figures

ICE MAKING MACHINE

This is a continuation of application Ser. No. 921,835, filed July 3, 1978, now abandoned.

BACKGROUND AND SUMMARY OF THE INVENTION

In U.S. Pat. No. 2,949,019, issued Aug. 16, 1960; No. 3,465,537, issued Sept. 9, 1969; No. 3,559,424, issued Feb. 2, 1971; U.S. Pat. No. 26,101, issued Oct. 11, 1966; and No. 3,791,163, issued Feb. 12, 1974, all of which patents are assigned to the assignee of the present application, various types of ice making machines are disclosed for producing ice cubes or the like and which comprise a plurality of generally inverted ice cube cups or molds adapted to have water sprayed therewithin by means of a rotatable spray bar located below the molds. The ice cubes are adapted to drop downwardly into a chute during a subsequent ice harvest cycle, whereby the cubes are delivered to an ice storage bin to which access may be had through a suitable access opening or the like.

The present invention is generally related to an ice making machine of the above-described character; however, the apparatus of the present invention features a number of improvements over the various types of ice making machines shown in the aforesaid patents. In particular, the ice making machine of the present invention is intended to produce a relatively large volume of ice cubes over a given period of time, as compared to the machines disclosed in the aforementioned prior art patents, which ice producing capacity is attributed to the arrangement and cooperation between a plurality of ice producing mechanisms that are oriented in two tandem pairs and adapted to have the ice cubes produced thereby drop downwardly into a common ice storage bin located below the ice producing mechanisms. This arrangement of the ice producing mechanisms is achieved as a result of the particular orientation of the water holding tank or platen, water sump, ice forming molds and water spray bar, all of which components are disposed in compact unitized assemblies that permit stacking two separate ice producing mechanisms on top of one another and incorporating two pair of such mechanisms within a common housing.

It is, accordingly, a general object of the present invention to provide a new and improved ice making machine.

It is a more particular object of the present invention to provide a new and improved ice making machine which is capable of producing large quantities of ice cubes over a given period of time.

It is still a more particular object of the present invention to provide a new and improved ice making machine, as above described, which incorporates a plurality of ice producing mechanisms in a common housing and which are arranged so as to have the ice cubes produced thereby transmitted to an adjacently located storage bin.

It is further object of the present invention to provide a new and improved ice making machine of the above character, the refrigeration systems of which utilize common components.

It is a more specific object of the present invention to provide a new and improved ice making machine, as above described, wherein one of the common refrigerant components utilized comprises the refrigeration condenser.

It is still another object of the present invention to provide a new and improved ice making machine wherein the condenser is hingedly mounted so as to be movable between a normally closed position and an open position providing access to the interior of the ice making machine for purposes of inspection, repair or the like.

It is yet another object of the present invention to provide a new and improved ice making machine of the above character wherein the ice producing mechanisms are fabricated of easily cleaned materials so as to satisfy the requisite sanitation standards attendant the production of ice.

It is a further object of the present invention to provide a new and improved ice making machine having a long and effective operational life and which may be easily installed and economically manufactured.

Other objects and advantages of the present invention will become apparent from the following detailed description taken in conjunction with the accompanying drawings.

BRIEF DESCRIPTION OF THE DRAWINGS

FIG. 3 is a top elevational view, partially broken away, of the ice producing section of the ice making machine of the present invention;

DESCRIPTION OF A PREFERRED EMBODIMENT

Figure 1:
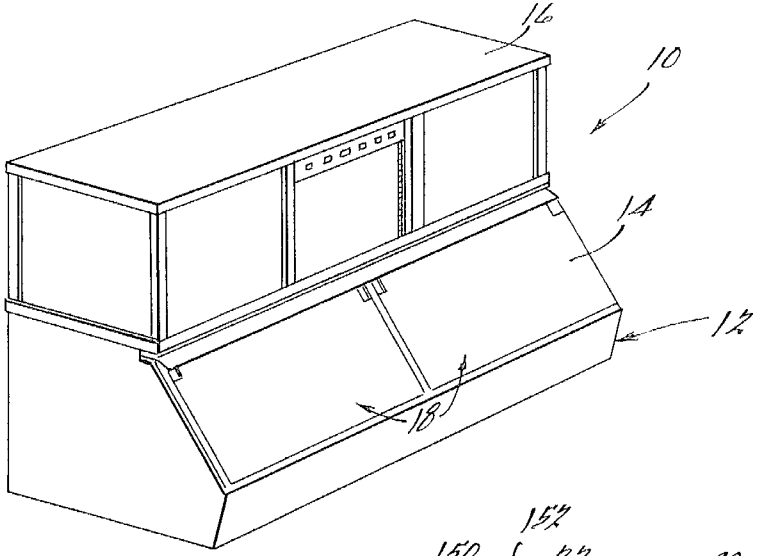
FIG. 1 is an elevated perspective view of one preferred embodiment of the ice making machine of the present invention.

Referring now in detail to the drawings and in particular to FIG. 1 thereof, an ice making machine 10, in accordance with one preferred embodiment of the present invention, is shown generally as comprising an external housing or enclosure 12 which includes a lower ice storage section 14 and an upper ice producing section 16. The construction of the ice storage section 14 may be of any suitable type and is preferably of a heat insulated construction. Suitable access doors 18 are provided on the forward side of the ice storage section 14 in order to permit removal of ice stored therein. Briefly, in operation of the present invention, the ice making machine 10 is adapted to produce successive batches of ice in cube or similar form, which cubes are transferred downwardly from the ice producing section 16 into the ice storage section 14 from which the cubes may be removed as needed. It is to be appreciated that the present invention is not in any way intended to be limited as being specifically associated with the ice storage section 14, since the ice producing section 16 may be readily used independently thereof wherein the cubes produced thereby are removed directly or are removed by means some type of ice cube conveying or transfering mechanism which functions to move the ice produced by the ice producing section 16 to some remote or adjacent facility where the cubes may be used or stored, as desired. Additionally, it is to be noted that the ice producing section 16 of the present invention may have one or more identical sections 16 surmounted or stacked thereupon to further increase the ice producing capacity of the machine and the particular arrangement of the ice producing mechanisms disposed therewithin and the ice transfer chutes embodied therewith renders the ice making machine 10 of the present invention adapted for such stacking of the ice producing section of the present invention, as will later be described.

Figure 2:
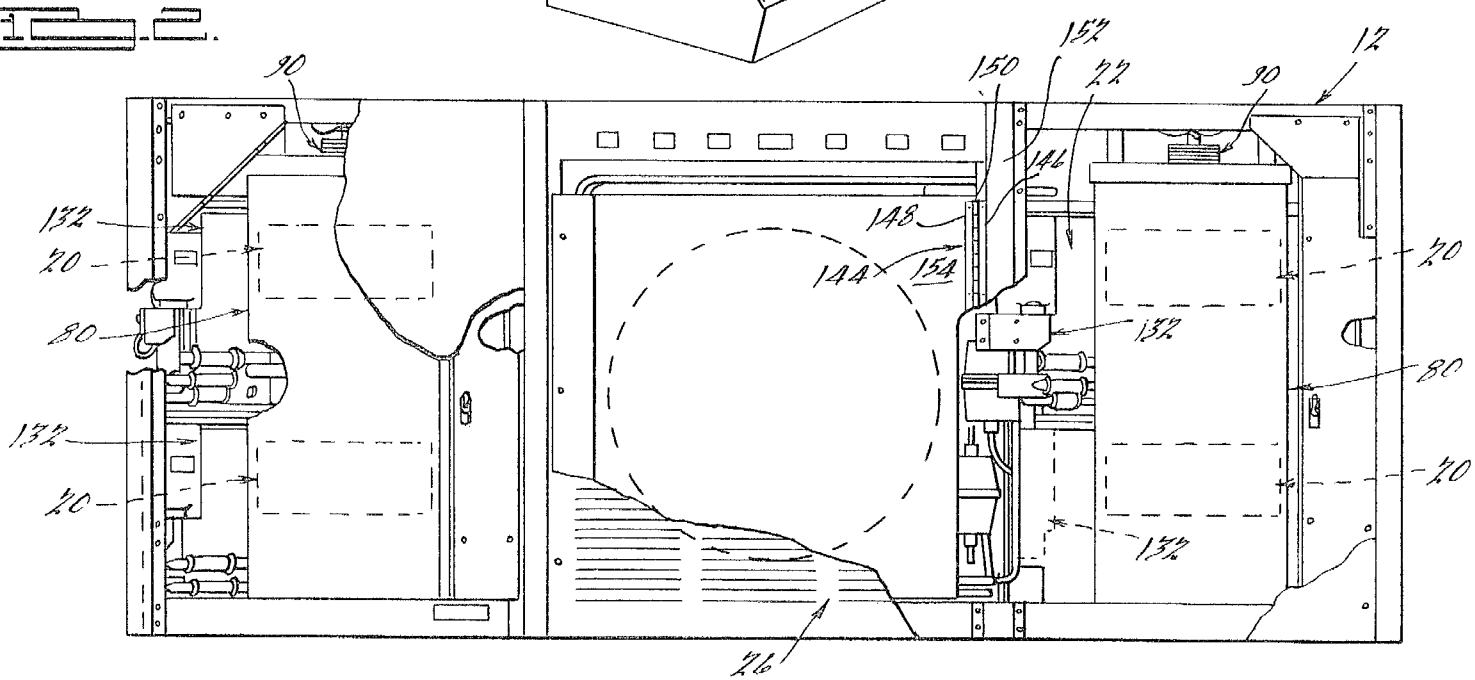
FIG. 2 is an enlarged side elevational view, partially broken away, of the ice producing section of the machine illustrated in FIG. 1.
Figure 2:
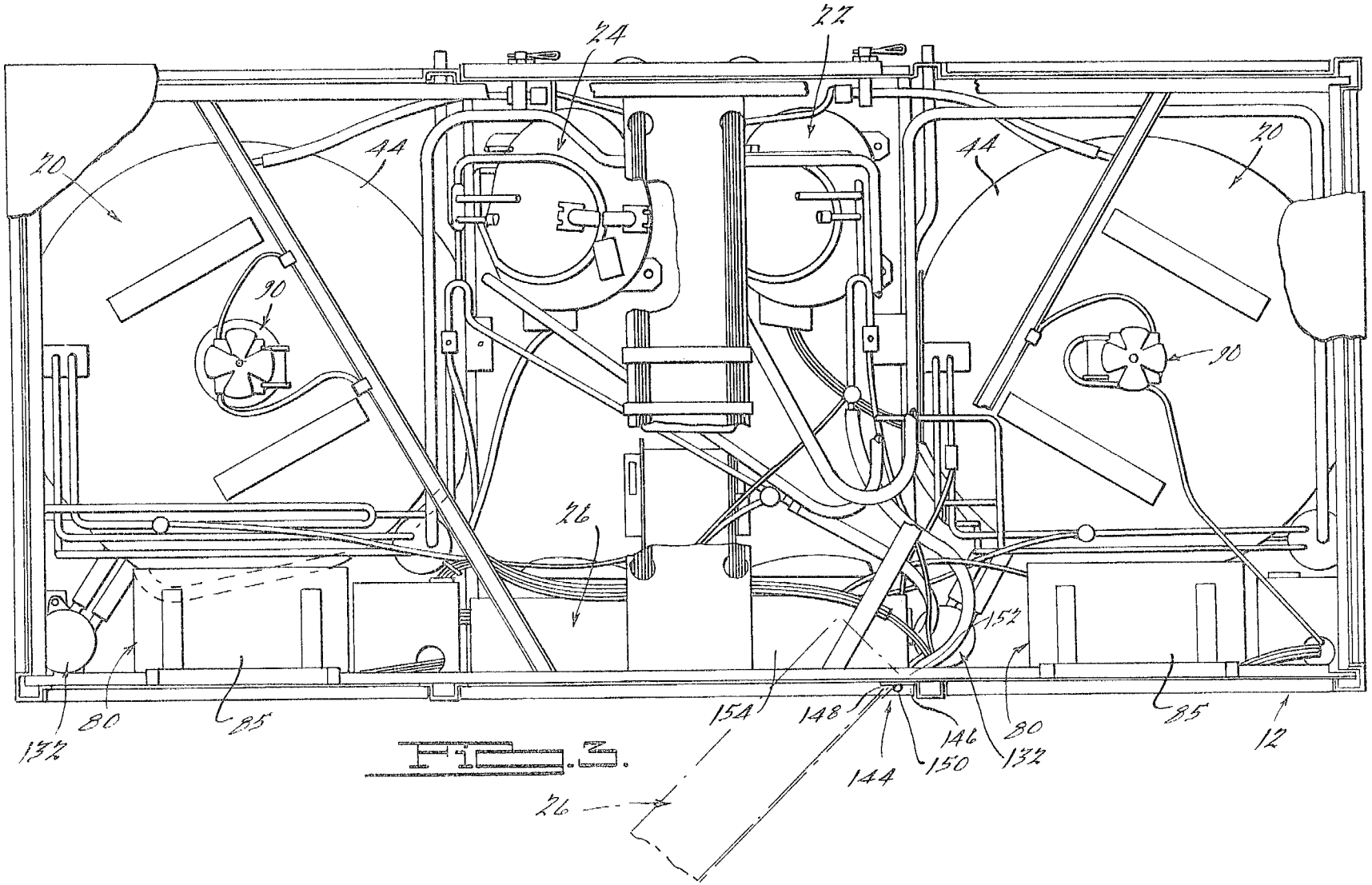

Referring now to FIGS. 2 and 3, the ice producing section 16 of the present invention incorporates a plurality of four freezer assemblies, generally designated by the numeral 20, which are tandemly arranged in two vertically stacked pairs of such assemblies 20. Additionally, the ice producing section 16 of the present invention incorporates a refrigeration system comprising a pair of refrigerant compressors 22 and 24 which are associated one with each pair of freezer assemblies 20. The refrigeration system incorporates a common refrigerant condenser, generally designated by the numeral 26, which serves both of the aforesaid compressors 22, 24, as well as four refrigerant evaporators 28 that are associated one with each of the freezer assemblies 20. The compressors 22, 24, condenser 26 and plurality of evaporators 28 are connected through conventional refrigerant conduits and are operatively associated with conventional refrigerant dryers and accumulator assemblies which are communicable with the outlets of the respective evaporators 28 and the inlets of the compressors 22, 24 so as to assure that only refrigerant gas is transmitted to the compressor inlets during operation of the ice making machine 10 of the present invention. As will be appreciated by those skilled in the art, the refrigeration system functions in a manner such that gaseous refrigerant at relatively high pressure is supplied by the compressors 22, 24 to the condenser 26, the refrigerant being cooled and liquified as it passes through the condenser 26. The thus cooled and liquified refrigerant then flows from the condenser 26 to the evaporators 28, where the refrigerant is vaporized by the transfer of heat thereto from water which is being formed into ice within each of the freezer assemblies 20. The gaseous refrigerant then flows from the evaporators 28 back to the inlet or suction sides of the compressors 20, 22 for recycling.

By virtue of the fact that each of the freezer assemblies 20 is identical in construction and operation, the following detailed description of one of the freezer assemblies 20 is intended to applicable to each of the two pair thereof embodied in the machine 10, and the following description of the tandem spray bar and drive arrangement therefor of one of the pair of freezer assemblies 20 is, of course, intended to be applicable to the analogous components of the other tandemly arranged pair of freezer assemblies 20.

Figure 4:
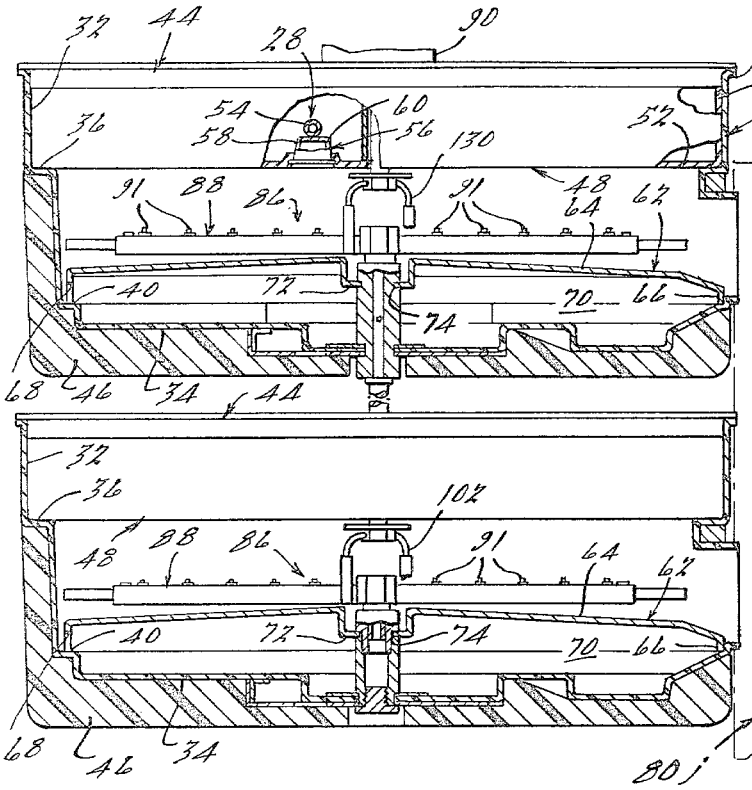
FIG. 4 is a transverse cross-sectional view of a pair of the ice producing mechanisms incorporated in the ice making machine of the present invention.

Referring now in detail to the freezer assemblies 20, as best seen in FIGS. 3 and 4, each of the assemblies 20 is shown as being generally circular in shape and comprises an enclosure 30 which is open at the upper end thereof and comprises a side wall section 32 which is of a generally cylindrical configuration. The lower end of the enclosure 30 is closed by an integral bottom wall section 34, as best seen in FIG. 4. Preferably, the enclosure 30 is formed of a suitable synthetic plastic material, such as polystyrene or the like, which may be easily cleaned and is adapted to be constructed by well known vaccum forming or similar fabricating techniques. As shown in FIG. 4, the side wall section 32 of the enclosure 30 is formed with a generally horizontally disposed inwardly projecting upper shoulder portion 36 which extends around the entire periphery of the enclosure 30. The side wall section 32 is also formed with a generally rectangularly-shaped ice discharge opening 38 that functions in a manner hereinafter to be described in communicating ice produced within the assembly 20 to the storage section 14 of the machine 10. The side wall section 32 of the enclosure 30 is further formed with a lower, generally horizontally disposed, inwardly projecting shoulder portion 40 which is disposed vertically below the shoulder portion 36 and functions in a manner hereinafter to be described. The upper end of the side wall section 32 is formed with a peripheral outwardly extending flange or lip portion 42 that cooperates with and functions to support a generally horizontally disposed cover member 44 which normally closes the upper end of the enclosure 30, as best seen in FIG. 4. In order to rigidify and strengthen the enclosure 30, a layer of a suitable rigid synthetic plastic foam material, designated by the numeral 46, is molded around the bottom wall section 34 and the portion of the side wall section 32 below the shoulder portion 36. The material 46 is preferably a polyurethane or similar polymeric cellular material, as is well known in the art.

Disposed within the upper end of the enclosure 30 is an ice forming platen, generally designated by the numeral 48, which consists of a generally circular side wall section 50 that is of a complementary configuration with respect to the shape of the enclosure 30. The side wall section 50 is integrally formed with a bottom or lower end section 52 which is generally horizontally disposed and also complementary in shape with respect to the enclosure 30. As illustrated, the entire platen 48 is adapted to be nestingly received within the upper end of the enclosure 30 and normally be supported upon the shoulder portion 36, with the cover member 44 being received in the position shown in FIG. 4, whereby to close or cover the upper end of the platen 48. Disposed interiorly of the platen 48 is the refrigerant evaporator 28 of the associated freezer assembly 20, which evaporator 28 consists of a length of refrigerant conduit or tubing 54 that is arranged in a generally serpentine configuration, including a plurality of generally spaced parallel conduit sections which are interconnected at their opposite ends so as to provide for the continuous refrigerant flow path within the upper end of the platen 48. Disposed between the underside of the evaporator tubing or conduit 54 and the bottom section 52 of the platen 48 is a plurality of inverted ice forming molds or cups, generally designated by the numeral 56. The cups 56 are arranged in spaced parallel rows which are generally vertically aligned with the parallel sections of the conduit 54, whereby a portion of the evaporator 28 passes directly above each of the cups 56. The cups 56 are of a generally frusto-conical configuration, i.e. are of a generally circular shape and decrease in cross-sectional size toward their upper ends, whereby ice which is formed therein may be released therefrom and drop downwardly away from the underside of the platen 48 during the harvest portion of the operational cycle of the ice making machine 10 of the present invention. Toward this end, each of the cups 56 comprises a downwardly and radially outwardly tapered side wall portion 58 and an upper, generally horizontally disposed top end portion 60. As will later be described, water is sprayed upwardly into the underside of the plurality of cups 56 during the freezing cycle of the machine 10, where such water freezes to form the ice dube products of the present invention.

In order to effectively communicate the ice cubes which are discharged through the openings 38 of the enclosures 30, each of the tandemly arranged pair of assemblies 20 is disposed adjacent a generally vertically oriented discharge chute 80, which chutes have four side walls, generally designated 82, the ones of which are adjacent the tandem freezer assemblies 20 being formed with suitable openings which are aligned with openings 38 of each of the enclosures 30 so that ice cubes may be passed through the openings 38 into the interior of the discharge chutes 80. The lower ends of the chutes 80 are open so that the cubes which are transmitted thereinto will drop downwardly through a suitable opening in the upper end of the storage section 14 so as to communicate ice cubes thereinto. Suitable gasket means 84 is preferably provided interjacent to the confronting portions of the chutes 80 and the side wall sections 32 of the enclosure 30, and the upper ends of the chutes 80 may be provided with suitable covers or the like 85 so as to provide for selective removal thereof for purposes hereinafter to be described.

Figure 5:
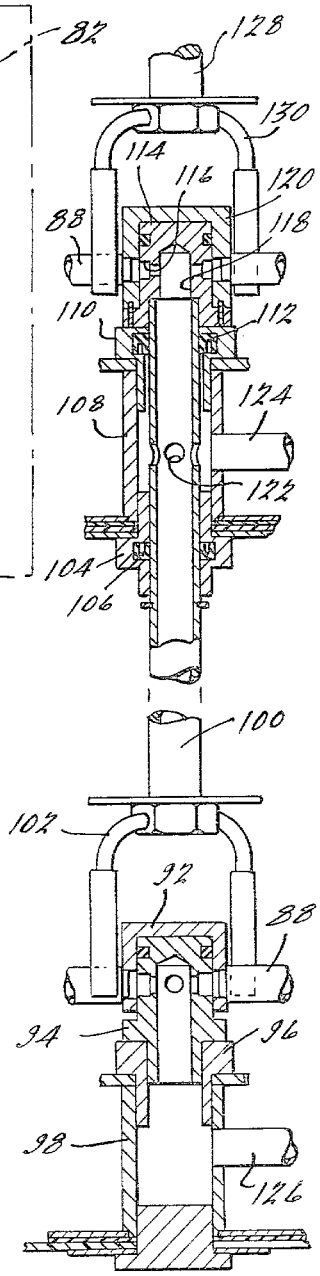
FIG. 5 is a longitudinal cross-sectional view of the spray bars and drive mechanisms therefor incorporated in the pair of ice producing mechanisms shown in FIG. 4.

The ice making mechanism associated with each of the freezer assemblies 20 is generally designated by the numeral 96 and incorporates a rotatable water spray bar 88. The spray bars 88 of each tandemly oriented pair of assemblies 20 are driven by a common electrically energized drive motor 90 located on top of the uppermost of the freezer assemblies 20. As illustrated in FIG. 4, each of the spray bars 88 is rotatably mounted between the upper side of the associated inner bottom member 62 and the underside of the associated platen 48 with each of the spray bars being provided with a series of upwardly directed water discharge or spray nozzles, generally designated by the numeral 91. As best seen in FIG. 5, the lowermost of the two rotatable spray bars 88 of each tandem pair thereof is operatively supported by means of a generally inverted cup-shaped support member 92 mounted upon a fluid fitting 94 and an associated fitting 96 communicable with a tubular member 98 to which water is supplied from an associated water pump hereinafter to be described. The lowermost spray bar 88 is adapted to be rotated by means of a generally vertically disposed tubular member 100, the lower end of which is provided with a suitable bifurcated yoke 102. The tubular member 100 extends upwardly and is rotatably carried within a lower bushing 104 provided on the lower end of the enclosure 30 of the uppermost of the tandemly arranged pair of freezer assemblies 20. The bushing 104 is provided with a suitable fluid seal 106 which prevents any fluid leakage between the inner periphery of the bushing 104 and the outer periphery of the member 100. The upper end of the member 100 extends upwardly within a tubular member 108, with the upper end of the tubular member 108 being provided with an upper bushing assembly 110 having a suitable fluid seal 112 and which functions to rotatably carry the extreme upper end of the member 100. Mounted upon the upper end of the member 100 is a fluid fitting 114, with the fitting 114 being provided with a plurality of outlet ports 116 and a central vertical fluid passage 118 which functions to communicate water to a cup-shaped support member 120 associated with the uppermost of the two associated spray bars 88. It will be seen that the portion of the member 100 located within the tubular member 108 is formed with a plurality of flow ports 122 which are communicable via the interior of the tubular member 108 with a water inlet conduit 124 which communicates with an associated water pump hereinafter to be described. In a similar manner, the tubular member 98 associated with the lowermost of the tandemly arranged pair of spray bars 88 is communicable with a suitable water conduit 126 which transmits water from an associated water pump to the said lower spray bar 88. The entire assemblage including the tubular member 100 and upper and lower spray bars 88 is adapted to be rotated by means of a drive shaft 128 and yoke 130, the former of which is driven by the aforementioned drive motor 90 located on the uppermost cover member 44. As illustrated, the yoke 130 is engageable with the uppermost of the tandemly arranged pair of spray bars 88 in order to effect rotation thereof and concomitant rotation of the associated lower spray bar 88 upon rotation of the shaft 128, as will be apparent to those skilled in the art.

The water system of the ice making machine 10 of the present invention may be of any suitable construction designed so as to provide a source of water for the spray bars 88 of the respective freezer assemblies 20. By way of example, the water system includes a plurality of four water pumps, generally designated by the numeral 132, which are adapted to selectively supply water to each of the aforesaid spray bars 88 during the freezing portion of the cycle and then provide make-up water to the interior of the platens 48 to supplement the hot gas flowing through the evaporators during the harvest portion of the cycle in order to heat the plurality of ice forming molds or cups 56 and effect release of the ice therein. If desired, the make-up water may be heated, as described in the aforementioned U.S. Pat. No. 3,791,163.

In accordance with one important feature of the present invention, the refrigeration systems associated with the four freezer assemblies 20 embody a common refrigerant condenser 26 which, as will be appreciated by those skilled in the art, materially reduces the space requirements for the refrigeration systems within the housing or enclosure 12, as well as the initial cost thereof, as compared to a system that might embody a separate condenser for each of the refrigeration systems. In accordance with another feature of the present invention, the condenser 26 is mounted within the enclosure 12 in a manner so as to be moved between a normally closed position and an open position in order to provide access to the interior of the ice producing section 16, for purposes of inspection, repair, maintenance, etc. More particularly and as best seen in FIG. 3, the housing 12 is provided with a generally vertically oriented hinge assembly, generally designated by the numeral 144 and comprising a pair of cooperable hinge sections 146 and 148 that are pivotably or hingedly connected by means of a conventional hinge pin or pintal 150. The hinge section 146 is adapted to be fixedly secured to a generally vertically extending structural portion or frame of the housing 12, as by suitable screws, bolts or the like, while the hinge section 148 is adapted to be secured in a similar manner to the housing of the condenser 26, whereby when the condenser 26 is normally disposed in the solid line position shown in FIG. 3, the rearward side thereof is generally flush or coplanar with the adjacent side of the ice producing section 16. At such time as it is desired to provide access to the interior of the enclosure 12, for example, for purposes of inspecting or repairing the compressors 22, 24 and/or any other portions of the refrigeration, electrical or water systems incorporated in the machine 10, the condenser 26 may be pivoted about the generally vertically disposed axis defined by the hinge pin 150 to the phantom line position shown in FIG. 3 to provide such access to the interior of the machine 10. Of course, at such time as the inspection or repair operation has been completed, the condenser 26 may be again pivoted from the phantom line position in FIG. 3 to the solid line position shown in this figure. In a preferred construction of the present invention, the capillary tubing associated with the refrigeration system of the machine 10 may be mounted about a generally vertically disposed axis arranged parallel to the hinge axis of the hinge assembly 144 and be adapted for torsional movement about such axis. With this arrangement, the refrigeration condenser associated and communicable with the capillary tubing, which would ordinarily have to be of a relatively flexible construction in order to accommodate for the pivotal movement of the condenser 26 between its respective open and closed positions, can now be fabricated of a relatively rigid or stiff conduit material which is somewhat more economical than the comparable flexible conduit.

In operation of the ice making machine 10 of the present invention, assuming the initial conditions that the plurality of ice molds or cups 56 are empty; that the sump 70 in each of the freezer assemblies 20 contains a quantity of make-up water to be used in forming ice cubes within the associated cups 56, that the electric motors 90 on the uppermost of the two tandem pair of freezer assemblies 20 are energized to effect rotation of the spray bars 88 therewithin, that the water pumps 132 are operable to pump water from the sumps 70 to the plurality of nozzles 91 on the spray bars 88, and assuming that the associated electrical control circuit is properly actuated, for example, by means of an ice level control switch within the ice storage section 14 of the housing 12 pursuant to a suitable electrical control circuit, such as is described in U.S. Pat. No. 3,791,193, which will result in at least one, and possibly more complete freezing and harvest cycles of each of the freezer assemblies 20, the freezing cycle of the ice making machine 10 is initiated by energization of the refrigeration compressors 22, 24. As the compressors, 22, 24 are started, refrigerant will be forced to the condenser 26 and will thereafter be communicated to the evaporators 28 of each of the freezer assemblies 20. The refrigerant will then flow through and be vaporized within the evaporators 28 and then be returned to the respective compressors 22, 24. Simultaneously, the spray bars 88 will rotate below the plurality of ice forming cups 56 and the water pumps 132 will force water upwardly through the plurality of nozzles 91, with the result that such water will be directed into the open undersides of the cups 56.

As a result of the water being sprayed into the cups 56 and normal operation of the refrigeration systems associated therewith, ice cubes will begin to form within the cups 56, with any excess water from the nozzles 91 dropping downwardly and falling upon the upper sides of the inner bottom members 62 and thereafter flowing through the plurality of notches 68 back into the associated sumps 70. After the freezing portion of the cycle has progressed a predetermined length of time, which may, for example, be controlled by the temperature and pressure conditions of the respective evaporators 28, the freezing portion of the operational cycle will end and the harvest portion of the cycle will be initiated. When this occurs, hot refrigerant gas is communicated through the evaporators 28 and if desired, make-up water for the next successive ice cube batch to be formed is communicated into the platens 48, resulting in the outer surfaces of the cubes formed within the cups 56 being thawed to effect release of the cubes from the cups 56, whereby the cubes will drop downwardly upon the associated inner bottom members 62 and will be biased under the influence of gravity and the rotational movement of the associated spray bars 88 through the discharge openings 38 of the enclosures 30, whereby the ice will drop downwardly through the ice discharge chutes 80 into the ice storage section 14 of the machine 10.

As previously mentioned, it may be desired to increase the capacity of the ice making machine 10 even greater than that provided by the plurality of freezer assemblies 20, in which event, it may be possible to stack two or more separate ice storage sections 16 on top of the ice storage section 16. Thus, one or more of the ice producing sections 16 may be added or removed from an already existing installation to increase or decrease the ice producing capacity of the machine 10 and without disrupting the existing ice cube producing equipment. Toward this end, it will be noted that when two or more ice producing sections 16 are stacked on top of one another, the appropriate portions of the top and bottom walls of the housing or enclosures 12 thereof may be removed so that ice cubes produced by the upper machines will drop downwardly through the housings of the machines located therebelow, with such ice eventually dropping into the associated storage section 14. In such an installation, the ice discharge chutes 80 of each of the stacked machines will be arranged vertically with one another, whereby to provide an interrupted flow path for the ice produced by the stacked machines to the ice storage section 14, once the respective ice chute covers 85 are properly removed.

It will be seen from the foregoing that the present invention provides a new and improved ice making machine which incorporates a number of highly desirable features not shown in similar machines of the prior art. In particular, the ice making machine 10 of the present invention incorporates a novel arrangement of freezer assemblies which permits the production of a relatively high volume of ice, and a capacity which may be further increased through the stacking of successive ice making sections 16 on top of one another. Another feature of the present invention resides in the fact that the refrigerant systems associated with each of the freezer assemblies 20 utilize a common condenser which significantly minimizes the space requirements of the attendant refrigeration systems, and by virtue of the fact that the condenser is mounted for movement to and from a normal position closing an access opening to the interior of the ice producing section 16, convenient access may be had thereto for purposes of inspection, repair, maintenance or the like without requiring complete disassembly of the ice producing section 16.

While it will be apparent that the preferred embodiment of the invention disclosed is well calculated to fulfill the objects above stated it will be appreciated that the invention is susceptible to modification, variation and change without departing from the proper scope or fair meaning of the subjoined claims.

We claim:

1. An ice making machine comprising, an ice storage compartment having ice inlet means at the upper side thereof and an access opening through which ice may be removed from the interior thereof, an ice producing enclosure having a width dimension substantially greater than its height dimension disposed directly upon the upper side of said storage compartment and having ice outlet means in the lower side thereof arranged in general vertical registry with said ice inlet means in said storage compartment, whereby ice produced in said enclosure may drop downwardly from said enclosure into said storage compartment, two pairs of tandemly arranged ice producing mechanisms oriented in side-by-side relation within and adjacent the laterally opposite ends of said ice producing enclosure, each of said pair of mechanisms being generally vertically arranged within said enclosure, a pair of spaced apart vertically arranged ice chutes associated one with each of said tandemly arranged pair of ice producing mechanisms for transferring ice from said mechanisms toward said ice outlet means in said enclosure, a refrigeration system including a separate compressor and evaporator for said tandemly arranged ice producing mechanisms, and a common refrigerant condenser assembly operatively associated with each of said refrigeration systems, said condenser assembly being generally vertically oriented between said tandemly arranged pairs of ice producing mechanisms and comprising a portion of the vertical forward side of said enclosure, said condenser assembly being hingedly movable about a generally vertical hinge axis between a first position wherein the outer side of said assembly is generally coplanar with said vertical forward side of said enclosure, and a second position arranged at an angle to the plane of said vertical forward side of said enclosure providing access to said refrigerant compressors which are disposed generally between said pairs of mechanisms and behind said condenser assembly, and which includes refrigerant conduit means communicating refrigerant between said condenser assembly and said refrigeration system, and wherein at least a portion of said refrigerant conduit means is adapted for torsional movement upon hinged movement of said condenser assembly about said hinged axis between said first and second positions.

2. The invention as set forth in claim 1 wherein said portion of said conduit is arranged generally parallel to an axis about which said condenser is movable.

3. The invention as set forth in claim 2 wherein said conduit portion and said axis are generally vertically oriented.

* * * * *

UNITED STATES PATENT AND TRADEMARK OFFICE

CERTIFICATE OF CORRECTION

PATENT NO. : 4,318,278

DATED : March 9, 1982

INVENTOR(S) : John T. Olson et al.

It is certified that error appears in the above-identified patent and that said Letters Patent is hereby corrected as shown below:

Column 1, line 11, "U.S." should read -- Reissue --.

Column 5, line 3, "underside" should read -- undersides --.

Signed and Sealed this

*Thirty-first* Day of *August 1982*

[SEAL]

*Attest:*

GERALD J. MOSSINGHOFF

*Attesting Officer*

*Commissioner of Patents and Trademarks*